United States Patent [19]

Cokefair

[11] 4,378,649

[45] Apr. 5, 1983

[54] REFLECTIVE SHIELD FOR GAS DISCHARGE DISPLAY

[75] Inventor: Jon Cokefair, Deerfield, Ill.

[73] Assignee: Cherry Electrical Products Corporation, Waukegan, Ill.

[21] Appl. No.: 171,702

[22] Filed: Jul. 24, 1980

[51] Int. Cl.[3] ..... G09F 13/22; H01J 17/48; H01J 63/04; H05B 33/10

[52] U.S. Cl. ..... 40/544; 340/759; 313/518; 313/519; 315/169.3

[58] Field of Search ..... 40/544; 340/756, 758, 340/759, 774, 718; 313/518, 519; 315/169.3

[56] References Cited

U.S. PATENT DOCUMENTS

| | | | |
|---|---|---|---|
| 3,578,538 | 5/1971 | Presser et al. | 40/544 |
| 3,652,891 | 3/1972 | Janning | 340/759 |
| 3,711,733 | 1/1973 | Skutt | 340/758 |
| 4,013,912 | 3/1977 | Hinson | 340/759 |

*Primary Examiner*—Gene Mancene
*Assistant Examiner*—Michael J. Foycik
*Attorney, Agent, or Firm*—Hume, Clement, Brinks, Willian & Olds, Ltd.

[57] ABSTRACT

In display panels consisting of an envelope formed by a face plate and a base plate sealed together and filled with a gas suitable for supporting cathode glow, and having masking of the sealing material within the envelope to prevent spurious reflection therefrom.

7 Claims, 4 Drawing Figures

REFLECTIVE SHIELD FOR GAS DISCHARGE DISPLAY

SUMMARY OF THE INVENTION

This invention relates to a gas discharge display that consists of two sheets of glass sealed together about their peripheral edges with a glass frit, creating a sealed envelope.

This envelope of glass sheets is then filled with an ionizable gas mixture that, together with a series of electrically charged cathodes printed on one inner face of one of the glass sheets, coacts with associate charged anodes printed on the confronting face of the other glass sheet and forms a visible digital display panel.

In the prior art, a problem occurs when the gas is ionized. The glow discharge between the activated cathodes and anodes within the envelope reflect off the inner edges of the sealing material, causing an apparent glowing area in an undesired region of the envelope, particularly when the display is viewed from the front. This reflection can be mistaken for another activated digit.

To solve the problem, it was necessary to mask this reflective area from view, and this was accomplished by printing a shield on the anode surface of the glass envelope. This shield obstructed the area of the sealed material from reflecting the glow and resulted in a direct reading of only the activated digits.

DESCRIPTION OF THE DRAWING

The information will be best understood by reference to the accompanied drawing which illustrates the preferred mode of construction by which the objects of the invention are achieved and in which.

DESCRIPTION OF THE PREFERRED EMBODIMENT

Figure 1:
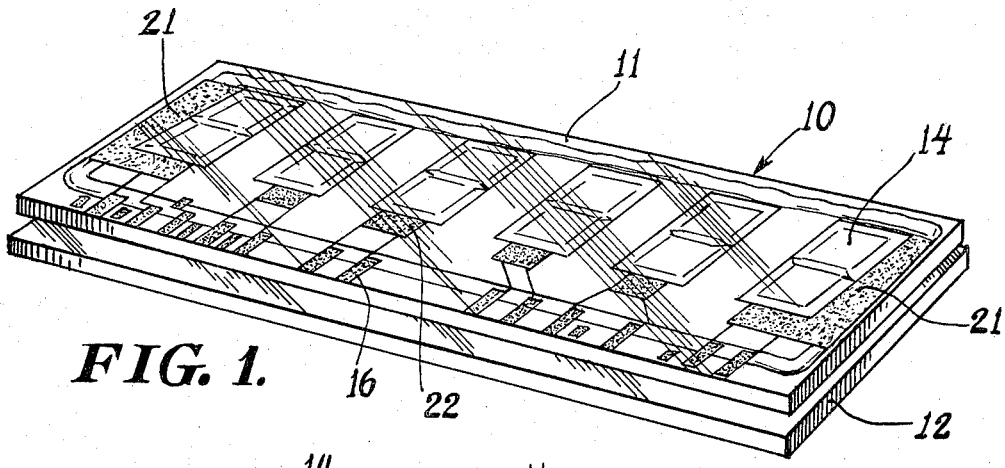
FIG. 1 is a perspective view of the discharge display panel of the invention.

A display panel 10 is perspectively shown in FIG. 1 and as such illustrates a sealed envelope consisting of a face plate 11 and a base plate 12. These plates are preferably formed from a thin flat glass sheet which may have substantially any desired size and shape.

Figure 2:
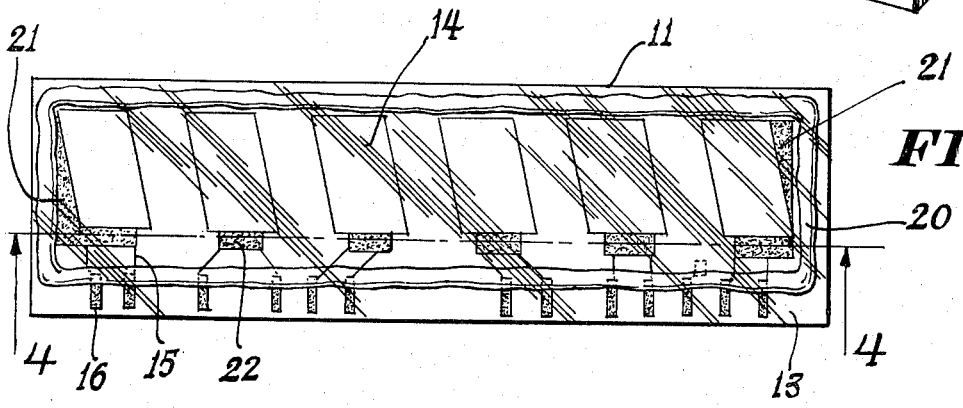
FIG. 2 is a plain view of the inner surface of one of the glass sheets of the invention.

As shown in FIG. 2, the inner surface 13 of the face plate 11 has screen printed thereon a plurality of anode pads 14. Each of these pads 14 by suitable leads 15 extends into external terminal connections 16 at the exposed edge of the plate.

Figure 3:
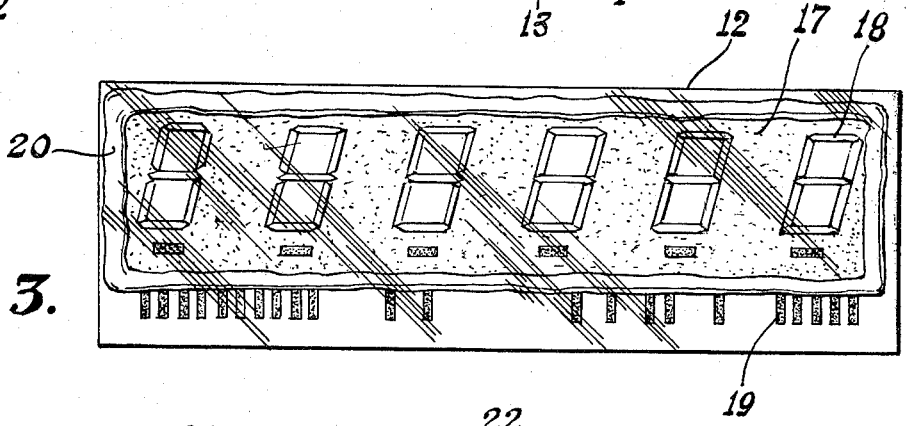
FIG. 3 is a plain view of the confronting surface of the other glass panel of the invention.
Figure 4:
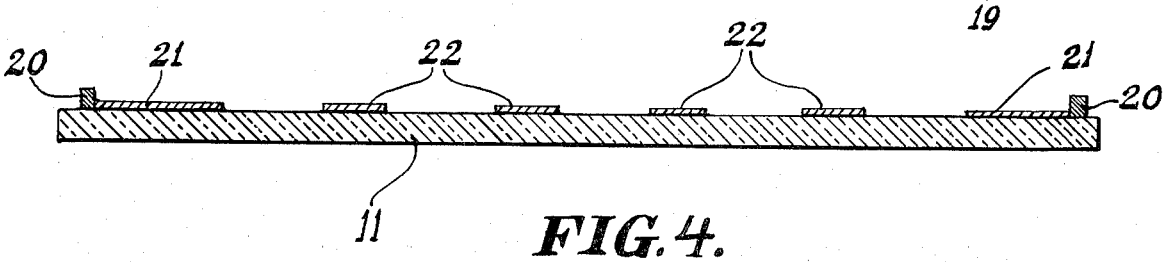
FIG. 4 is a detailed sectional view taken on line 4—4 of FIG. 2.

FIG. 3 shows the base plate 12 as having its confronting surface 17 screen printed with cathode segments 18 making up identifiable digits. As shown, the base plate 12 includes a six digit display. Each of the cathode segments 18 are connected by leads not shown to external terminal connectors 19.

Each of the confronting surfaces of the face plate 11 and base plate 12 has a viewing area defined by a sealing element 20 comprised of a glass adhesive mixture. The glass adhesive mixture is applied as a fluid mixture of powdered glass in a suitable binder or carrier.

As noted in the drawings, this sealing element 20 embraces the anodes 14 and their leads 15 as well as the cathode segments 18 and their leads. When the plates 11 and 12 are mated into a complete panel, as shown in FIG. 1, the adhesive mixture of the sealing element 20 when heated creates a sealed envelope between the face plate and the base plate 12. This envelope is sealed with a well-known ionizable gas such as neon, argon, xeron, in a manner well-known in the art.

When a suitable current is applied from an external source through the terminal 16 and 19 and the respective leads of the anodes 14 and cathode segments 18, there will be provided an electrical discharge which will then ionize the enclosed gas and result in cathode glow adjacent to the energized cathode segment which, in turn, will display the desired digit.

The foregoing is a description of a known form of construction for a gas discharge display. However, it has been found that spurious glow reflection from the adhesive mixture, particularly along the opposite ends of the panel adjacent to the elongate cathode segments, becomes apparent upon a frontal viewing of the display. This reflection in the past has been mistaken for an additional digit, which is highly undesirable.

To overcome this inherent problem, the anode sealing surface of the face plate 11 is provided with a printed opaque anode mask that has horizontally and vertically extending portions which are positioned between outer edges of the anode pads 14 and the sealing element 20. The portions of the anode mask can be positioned and dimensioned to block any undesirable cathode glow reflections from the sealing element which would otherwise be viewed for example on the top, bottom or side edges of the display. As shown in FIG. 2, portions 21 of the anode mask may be positioned between the sealing element 20 and the outer side edges of the anode pads at the ends of the display to block end reflections from the sealing element.

This example, defining a distinctive digit display, illustrates a simple yet efficient method of masking glow discharge from within the panel envelope. The method is economical in manufacturing in that the printing of the masking areas can be accomplished during the construction of the face plate, with such masking following the outline of certain of the anodes without additional indexing. The method also permits a semi-variable placement of the glass frit by which the plates are sealed together to form the display envelope.

While I have illustrated and described the presented form of construction for carrying my invention into effect, this is capable of variation and modification without departing from the spirit of the invention. I therefore do not wish to be limited to the precise details of construction as set forth, but desire to avail myself of such variations and modifications as come within the scope of the appended claims.

Having thus described my invention, what I claim as new and desire to protect by Letters Patent is:

1. A gas discharge display envelope comprising:

(a) a base plate having on one flat surface screen printed cathode display segments, (b) a face plate having on a confronting flat surface screen printed anodes, (c) a sealant on each plate adjacent to the peripheral edges thereof and embracing said cathode display segments and said anodes and sealing said plates together to form the display envelope, (d) first mask means for covering said base plate so that said cathode display segments are exposed to form glow discharge segments for viewing through said anode face plate, and (e) second mask means on said face plate extending inwardly of said sealant for shielding from view the light of the glow discharge of said cathode display segments reflected off of said sealant.

2. A gas discharge envelope as defined by claim 1, wherein said second mask means is made of a printable opaque material.

3. The gas discharge envelope of claim 1, wherein said second mask means includes a plurality of bottom masks disposed on the face plate, each bottom mask extending downwardly from the bottom edge of an associated one of said anodes, and wherein the gas discharge envelope further includes a plurality of electrically conducting terminals; and a plurality of pairs of electrically conducting leads disposed on the face plate, each pair of leads conductively connected to an associated one of the anodes and each lead extending downwardly to conductively contact an associated one of said terminals.

4. A gas discharge display device, comprising:

a cathode base plate having cathode display segments disposed thereon for selectively defining cathode glow patterns;

an anode face plate oriented in stacked, spaced relation to the cathode base plate, the anode face plate having anode areas positioned over said cathode display segments for forming said cathode glow patterns and for viewing the patterns;

a sealing means disposed between and adhering to said anode face plate and cathode base plate for holding the plates in stacked, spaced relation, the sealing means surrounding the cathode display segments and anode areas and forming a sealed ionization envelope between the face plate and the base plate;

ionizable gas disposed in said envelope;

first mask means for covering said cathode base plate so that said cathode display segments are exposed for forming cathode glow patterns visible through said anode face plate; and second mask means having portions disposed between outer edges of said anode areas and associated opposite portions of said sealing means for blocking from view the light of the cathode glow that is reflected from the associated opposite portions of the sealing means.

5. The gas discharge display device of claim 4, wherein at least one of said portions of the second mask means extends from an outer edge of an anode area to the associated opposite portion of the sealing means.

6. The gas discharge display device of claim 4, wherein said portions of the second mask means are disposed on the anode face plate and are made of a printable opaque material.

7. The gas discharge display device of claim 4, wherein said second mask means includes opaque end mask portions disposed at opposite ends of the display device, each end mask portion extending between an end portion of the sealing means and at least the outer side edge of an end anode area for blocking from view cathode glow reflections from the end portion of the sealing means.

* * * * *

UNITED STATES PATENT AND TRADEMARK OFFICE

CERTIFICATE OF CORRECTION

PATENT NO. : 4,378,649

DATED : April 5, 1983

INVENTOR(S) : Jon Cokefair

It is certified that error appears in the above-identified patent and that said Letters Patent is hereby corrected as shown below:

On the title page, under "U.S. PATENT DOCUMENTS," delete "Presser" and insert --Prosser--.

In column 1, line 39, delete "plain" and insert --plan--.

In column 1, line 41, delete "plain" and insert --plan--.

Signed and Sealed this

*Twentieth* Day of *December 1983*

[SEAL]

*Attest:*

GERALD J. MOSSINGHOFF

*Attesting Officer*

*Commissioner of Patents and Trademarks*